US005447217A

United States Patent [19]

Chou

[11] Patent Number: 5,447,217

[45] Date of Patent: Sep. 5, 1995

[54] ADJUSTABLE TOWING HANDLE FOR A TRUNK

[76] Inventor: Cheng-Tsan Chou, No. 27, Lane 280, Chung-Chen Rd., Sha Lu Chen Taichung Hsien, Taiwan

[21] Appl. No.: 248,684

[22] Filed: May 25, 1994

[51] Int. Cl.[6] ..... A45C 5/14; A45C 13/28

[52] U.S. Cl. ..... 190/18 A; 190/115; 16/115; 280/37; 280/47.315

[58] Field of Search ..... 190/39, 18 A, 18 R, 190/115, 117; 280/37, 47.29, 655, 655.1, 47.371, 47.315; 16/115

[56] References Cited

U.S. PATENT DOCUMENTS

| | | | |
|---|---|---|---|
| 3,522,955 | 8/1970 | Warner, Jr. | 280/655.1 |
| 4,974,871 | 12/1990 | Mao | 280/655 |
| 5,024,455 | 6/1991 | Schrecongost | 190/18 A X |
| 5,116,289 | 5/1992 | Pond et al. | 280/655.1 X |
| 5,257,800 | 11/1993 | Yang | 280/47.29 |
| 5,291,976 | 3/1994 | Ku | 190/39 X |
| 5,295,565 | 3/1994 | Latshaw | 190/24 X |
| 5,323,886 | 6/1994 | Chen | 190/18 A |

FOREIGN PATENT DOCUMENTS

| | | | |
|---|---|---|---|
| 2632262 | 12/1989 | France | 190/18 A |
| 2754562 | 6/1979 | Germany | 280/655.1 |

*Primary Examiner*—Sue A. Weaver

*Attorney, Agent, or Firm*—Bacon & Thomas

[57] ABSTRACT

The present invention relates to an adjustable towing handle for a trunk to provide a towing structure that is convenient and practical to use and to increase the convenience for the use of the trunk. The adjustable handle has a support seat, two fixed rods, two adjustable ends, a fixed rod seat, and a control tube, with two pins. The control tube with springs and two pins are attached in the support seat and sealed with a coverplate. The fixed rod extends between the fixing rod seat and the support seat on the back of a trunk or case body. A handle is mounted on the adjustable ends and they are inserted into the two fixed rods. The pins are rotated by the motion of a body on the control tube to retain or release the adjustable rods to effect the adjusting and positioning of the adjustable handle.

1 Claim, 5 Drawing Sheets

ADJUSTABLE TOWING HANDLE FOR A TRUNK

BACKGROUND OF THE INVENTION

The present invention relates to an adjustable towing handle for a trunk, and particularly to a multi-position expansion handle rather than a simple structure to permit only pulling out or retracting.

Because of travel getting popular, baggage handling has been changed from carrying by hand to trunks with towing handles and wheels through the combination of push carts with trunks. These not only can carry more goods, but are also convenient and labor-saving. However, the towing handle must be longer than the trunk body to facilitate pulling, but when not in use it is often not convenient for storage. A known towing handle is shown in FIGS. 1A–1C. The towing handle comprises an inner rod 50 and an outer rod 60, with inner rod 50 containing a latch 53. The distal end of latch 53 has a thrust block 52 extendible through the inner setting hole 51 in the inner rod 50. The end of outer rod 60 has a cap 70, and the cap 70 has an outer side hole 71 in communication with outer setting hole 61. Inner rod 50 is inserted in the outer rod 60. For use, inner rod 50 is extended out of outer rod 60. When inner setting hole 51, outer setting hole 61 and outer side hole 71 are in communication, thrust block 52 can thus extend from latch 53 for contact with outer rod 60. For storage, thrust block 52 is pressed into the inner rod 50 from outer side hole 71, then inner rod 50 is retracted into the outer rod 60. The above described conventional expansion link has the following defects:

1. Either for pulling out or pushing back the inner rod 50 the user has to press down said thrust block 52 first, then pull or push the inner rod 50. Such procedure is complicated and inconvenient.
2. Because the latch 53 is located in the inner rod 50 it is liable to be displaced, especially when the latch 53 undergoes elastic fatigue. Its positioning function would then become completely lost and cause structural instability.
3. When the inner rod 50 is pulled out, it has to be pulled out to the distal end of outer rod 60, i.e., the inner rod 50 must be completely pulled out. This does not allow for partially pulling out according to the specific need and does not allow for random positioning, so that its user flexibility is very low. Therefore, the present invention solves the defects found in the conventional expansion link.

These and other objects and advantages of the present invention will become apparent to those skilled in the art after considering the following detailed specification together with the accompanying drawings.

DETAILED DESCRIPTION OF PREFERRED EMBODIMENT

Figure 1B:
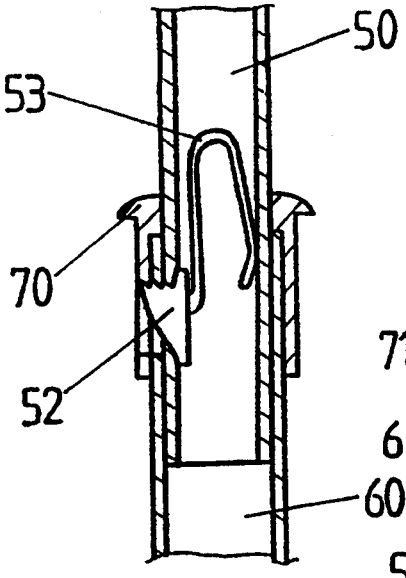
FIG.1B (PRIOR ART)
FIG. 1B is a partial cross-sectional view of the extendible handle of FIG. 1A showing the elements in latched position.
Figure 1C:
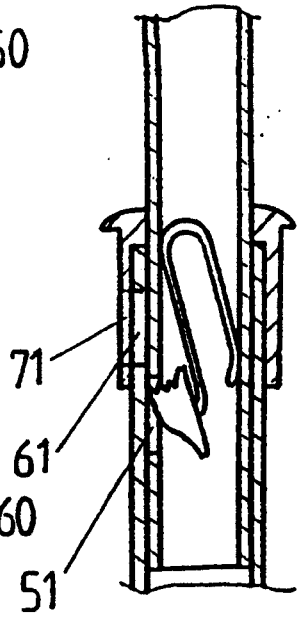
FIG.1C (PRIOR ART)
FIG. 1C is a partial cross-sectional view similar to FIG. 1 B showing the elements in unlatched position.
Figure 1A:
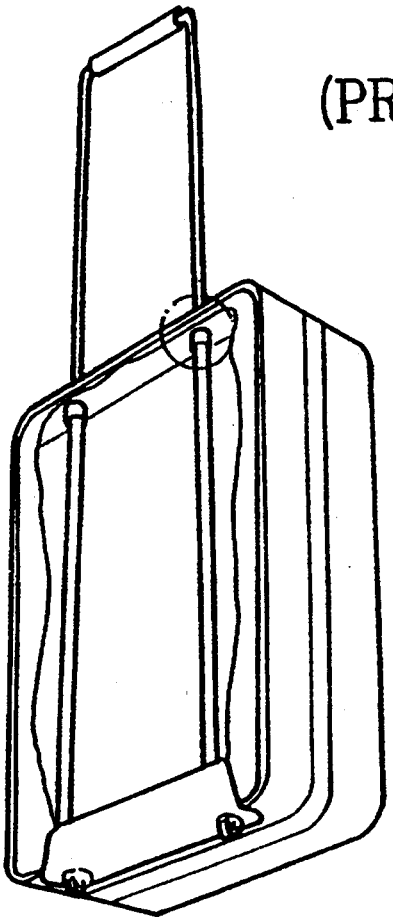
FIG.1A(PRIOR ART)
FIG. 1A is a perspective view partially broken away of a known extendible handle.
Figures 2A, 2B:
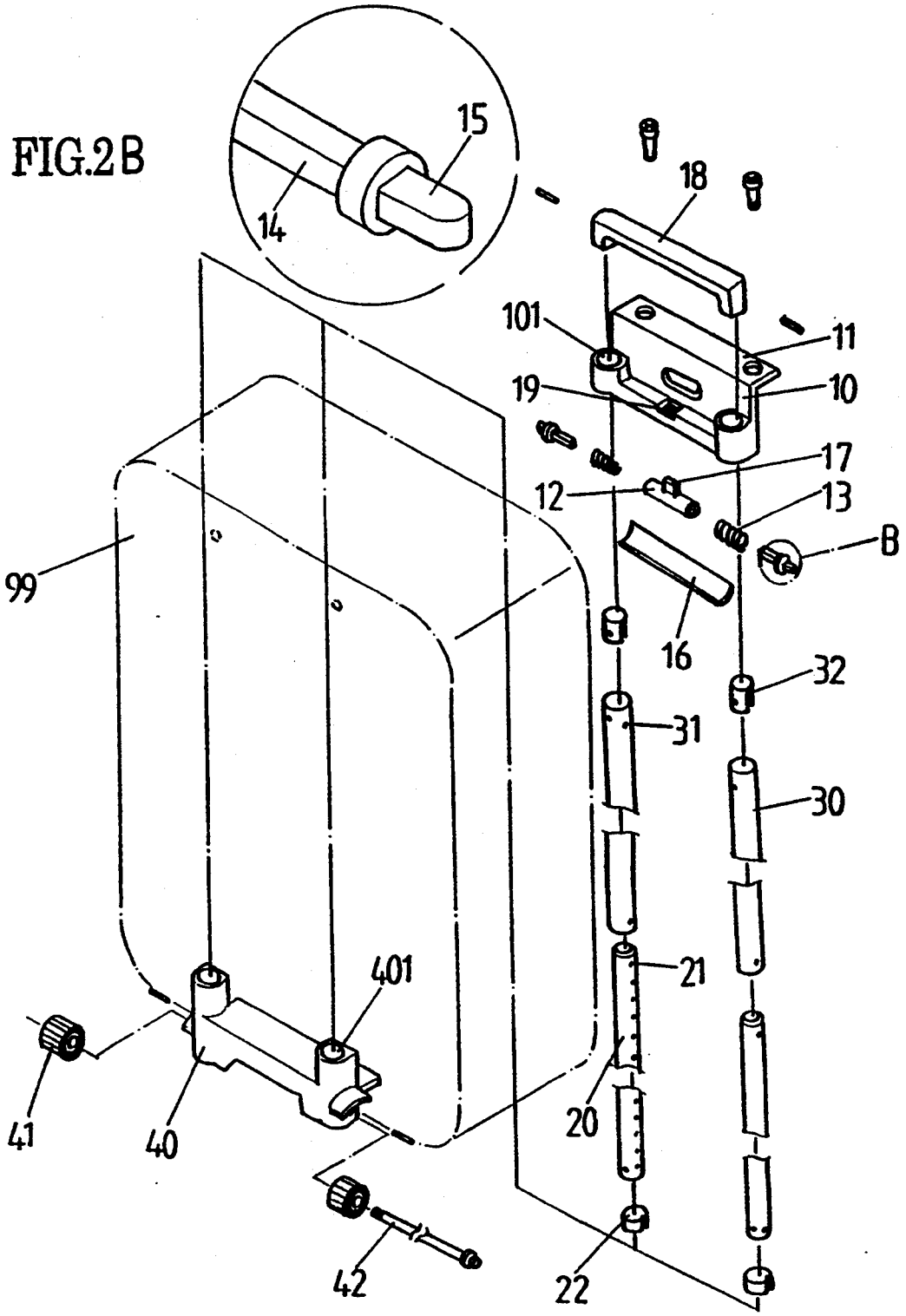
FIG. 2A is an exploded perspective view of the extendible handle according to the present invention.
FIG. 2B is an enlarged, partial, perspective view of area B in FIG. 2A.
Figure 3:
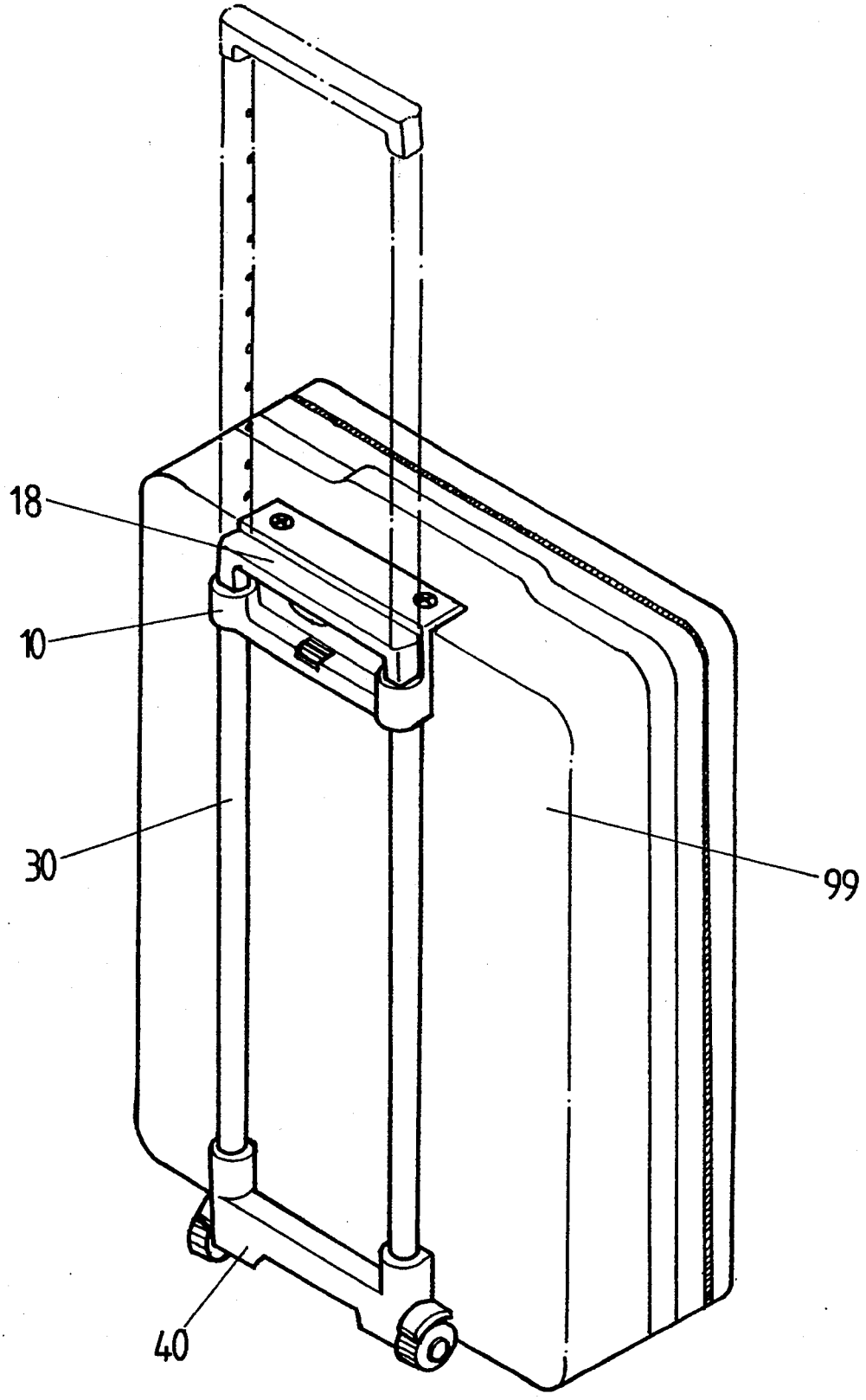
FIG. 3 is a perspective view of the overall assembly of the present invention.

Referring to FIGS. 2A and 2B, the present invention comprises support seat 10, control tube 12, adjustable rod 20, fixed rod 30 and fixed rod seat 40; wherein said support seat 10 is a seat body having a laterally extending location sheet 11, a lateral recess thereunder, a slot hole 19 and each end having an axial hole 101. Said control tube 12 is a short tube body having an inner polygonal configuration, and an intermediate body 17. Each side of the control tube has a pin 14 inserted therein, an end of said pin 14 having a flat configuration, while an opposite end has an arcuate head 15. Said adjustable rod 20 comprises a hollow stem in which are formed a plurality of location holes 21, and on which one end has a setting ring 22. Said fixed rod 30 comprises a hollow stem, with an upper end having a location hole 31 and sleeve 32. Each side of said fixed rod seat 40 has an axial hole with axle rod 42, extending therethrough with wheels 41 attached thereto. Each pin 14 has a spring 13 thereon located under support seat 10 and within said control tube 12 which is mounted such that body 17 projects through the slot hole 19. A coverplate 16 is mounted on support seat 10 beneath control tube 12. Fixed rod seat 40 is fixed on the back of case body 99. Fixed rods 30 are mounted in axial holes 401 and attached to said support seat 10 from a top side to enable the location sheet 11 to be attached to case body 99. Ends of fixed rods 30 extend into axial holes 101. Adjustable rods 20 are assembled to the setting rings 22, and, with location holes 21 facing inward, are mounted in said fixed rods 30, the port of fixed rod 30 is sealed with the sleeve 32 to prevent adjustable rod 20 from pulling out. Handle 18 is mounted to ends of adjustable rods 20 from the top side to form a complete adjustable link structure as shown in FIG. 3.

Figure 4:
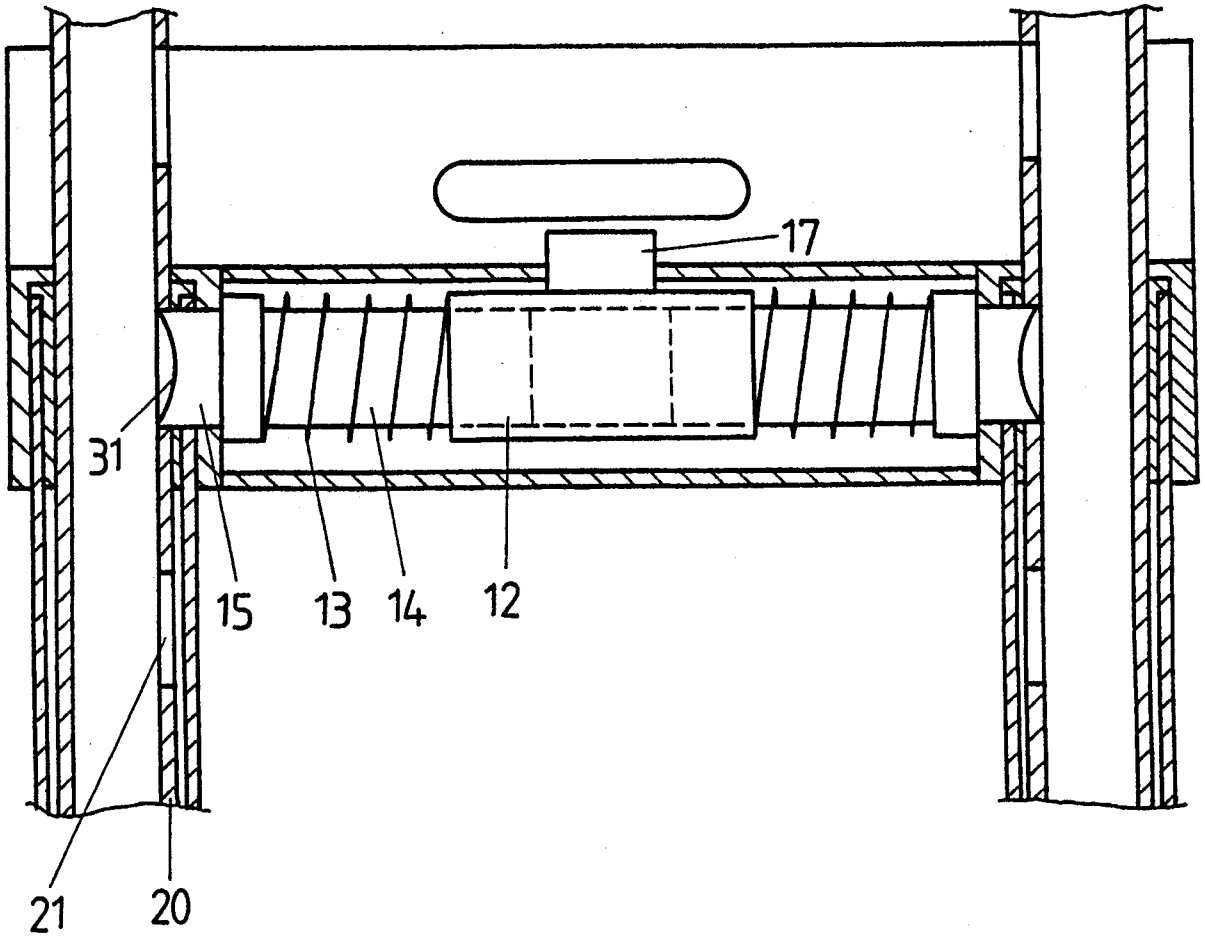
FIG. 4 is a partial cross-sectional view of the positioning device of the present invention in a latched position.
Figure 5:
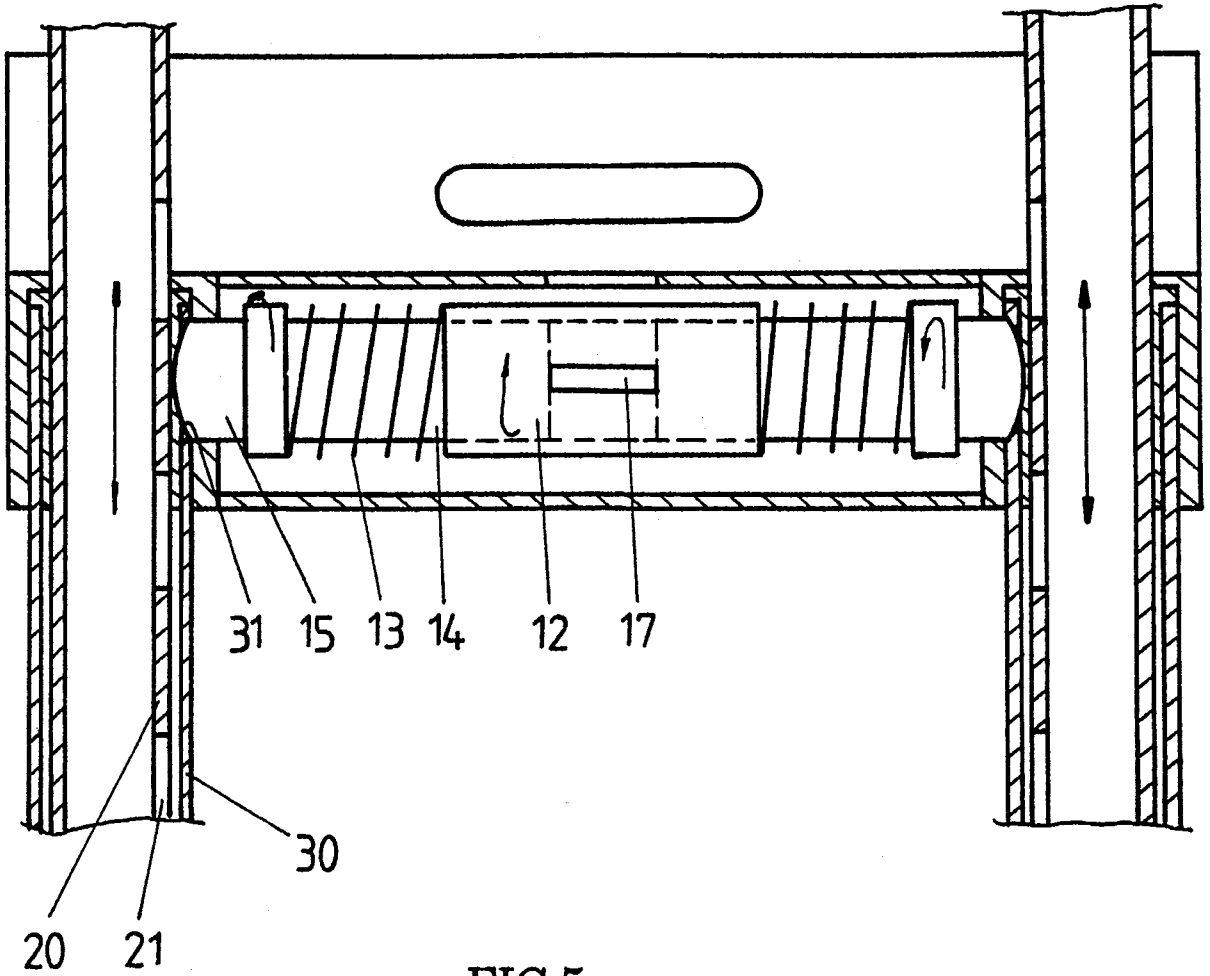
FIG. 5 is a partial cross-sectional view of the positioning device of the present invention in an unlatched position.

Referring to FIGS. 4 and 5, the head 15 of said pin 14 is formed in a curved plane and is pushed outward by spring 13 for insertion into location hole 31. Referring to FIG. 4, when a location hole 21 of adjustable rod 20 is aligned with a location hole 31 of fixed rod 30, the pin 14 will penetrate it to extend into holes 21 and 31 with pin head 15. Because of such engagement the adjustable rod 20 will be fixed in position. For extending or retracting, the body 17 is turned to enable the curved faces of pin heads 15 to contact location holes 21 and 31, changing into a curve face from a flat face. Pulling or pushing the handle 13 enables adjustable rod 20 to easily be released from the fixed position by curved face of pin head 15. When pulled up to the position desired, the body 17 is rotated back to its original position to enable pin head 15 to contact adjustable rod 20 with a flat face. If adjustable rod 20 is pulled too much, the end ring 22 will contact the sleeve 32 on top end of fixed rod 30 to limit movement without risk of withdrawal. Upon assembly of aforesaid components, the device will attain the advantages such as random positioning, and be labor saving, as well as being endurable for use.

I claim:

1. An adjustable towing handle for a trunk comprising:

a) a rod seat having wheels thereon and attached to the trunk;

b) a pair of hollow, fixed rods each having a first end portion attached to the rod seat and each having a second end portion;

c) a first location hole defined by each fixed rod adjacent to the second end portion such that the first location holes face toward each other;

d) a pair of adjustable rods each having a first end portion slidably located within one of the pair of fixed rods such that the adjustable rods are movable with respect to the fixed rods in a linear direction of movement and further having a second end portion;

e) a plurality of second location holes defined by each adjustable rod;

f) a handle attached to and extending between the second end portions of the adjustable rods;

g) a support seat attached to the trunk and to the second end portions of the fixed rods;

h) a releasing latching mechanism attached to the support seat and disposed between the fixed rods, the mechanism comprising:

i) a control tube including means for rotatable attachment to the support seat, the control tube having opposite ends with an inner polygonal configuration disposed between the fixed rods and being rotatable between first and second positions with respect to the support seat;

ii) a body extending from the control tube so as to facilitate manual rotation of the control tube between its first and second positions;

iii) a pair of pins each having a distal end with opposite flat surfaces interconnected by a convexly curved surface and including means for attachment to the control tube such that one of said pins extends from each opposite end of the control tube whereby the pins rotate with the control tube and may slidably move between extended and retracted positions with respect to the support seat and the location holes; and, iv) spring means acting on the pins urging them to their extended positions;

whereby in their extended positions the distal ends of each pin extends into aligned first and second location holes such that, when the control tube is in a first position, the fiat surfaces of the pins face in the linear direction of movement thereby preventing relative movement between the fixed rods and the adjustable rods, and when the control tube is in the second position, the adjustable rods contact the curved surfaces of the pins such that a force exerted on the adjustable rods will cause the pins to move to their retracted positions thereby enabling the adjustable rods to be moved with respect to the fixed rods.

* * * * *